US005366113A

United States Patent [19]

Kim et al.

[11] Patent Number: 5,366,113

[45] Date of Patent: Nov. 22, 1994

[54] PILL DISPENSER

[76] Inventors: David S. Kim, 2529 Date Cir., Torrance, Calif. 90505; Jae S. Kim, 2343 W. 227th St., Torrance, Calif. 90501

[21] Appl. No.: 165,484

[22] Filed: Dec. 13, 1993

[51] Int. Cl.[5] ..... B65H 1/08

[52] U.S. Cl. ..... 221/232; 221/279; 206/537

[58] Field of Search ..... 221/27–29, 221/267, 279, 247, 310, 307, 197, 198, 287, 231, 230, 228, 199, 217, 232, 226; 206/531, 536, 537; 141/22–24

[56] References Cited

U.S. PATENT DOCUMENTS 1,340,078 5/1920 Peoples ..... 141/23
2,443,861 6/1948 Johnston ..... 221/279
2,621,655 12/1952 Olson ..... 221/232
2,705,576 4/1955 Amelio et al. ..... 221/232
2,885,110 5/1959 Tregilgas ..... 221/279

*Primary Examiner*—Kenneth W. Noland
*Attorney, Agent, or Firm*—Harris, Wallen, MacDermott & Tinsley

[57] ABSTRACT

A dispenser for pills having a barrel with input and output ends, and a sleeve in the barrel for holding a stack of pills. An output end cap removably positioned at the output end of the barrel and including a cup for receiving a pill while the output end cap is positioned on the barrel, and a plunger for ejecting the pill from the cup when the output end cap is removed from the barrel. An input end cap positioned at the input end of the barrel and including a pusher sliding in the sleeve for pushing a pill from the sleeve into the cup.

13 Claims, 3 Drawing Sheets

FIG. 4
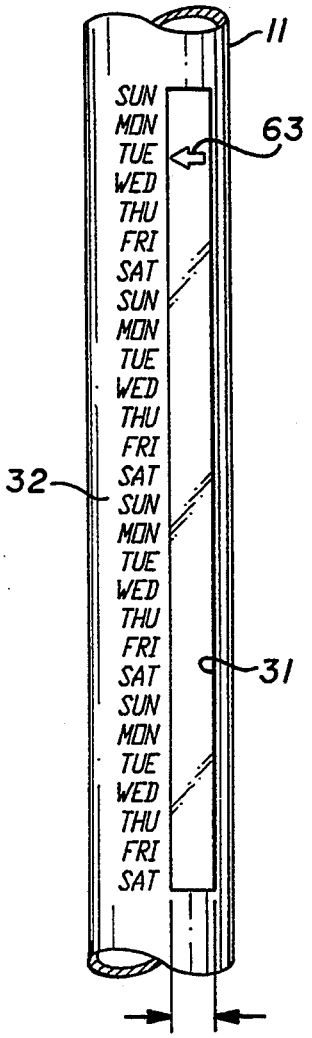
FIG. 6
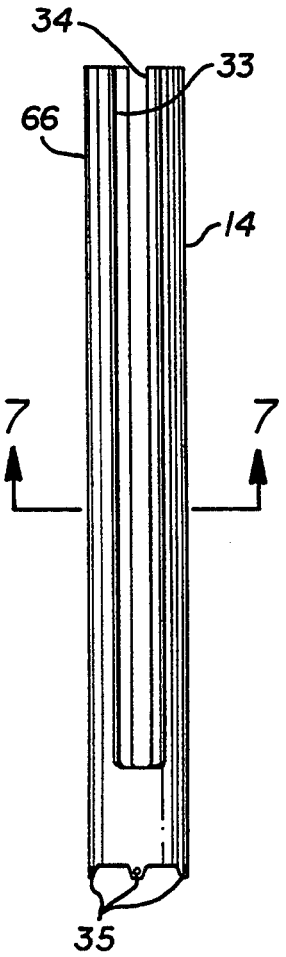
FIG. 7
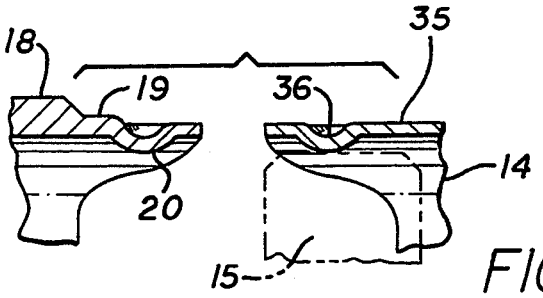
FIG. 5
FIG. 9
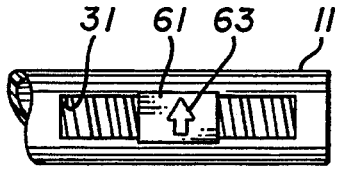
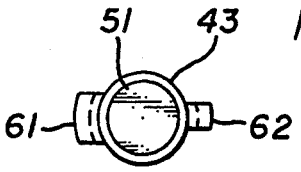
FIG. 8

FIG. 10
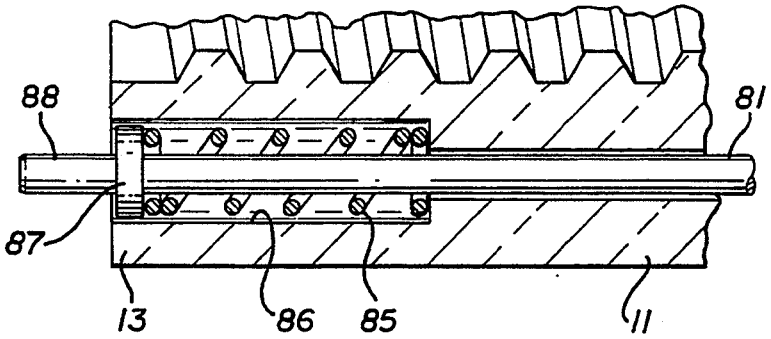
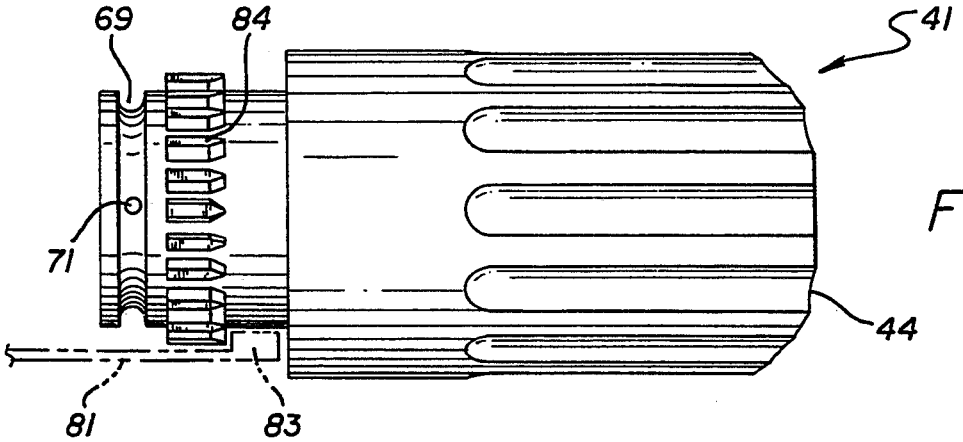
FIG. 11
FIG. 12
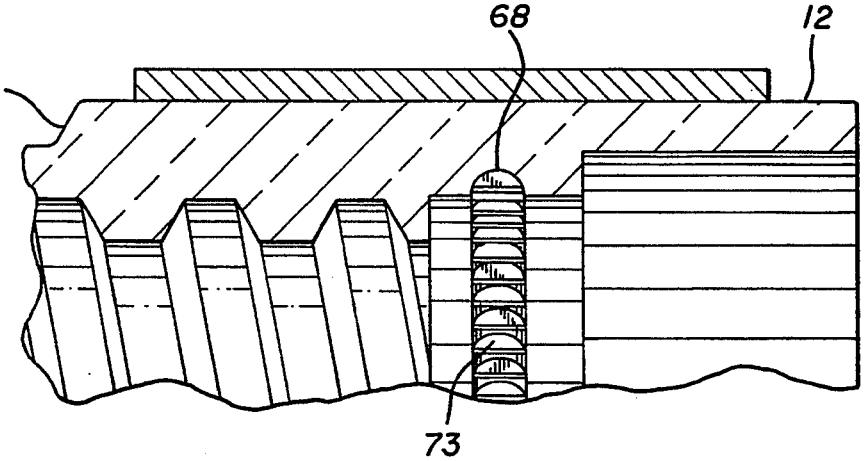
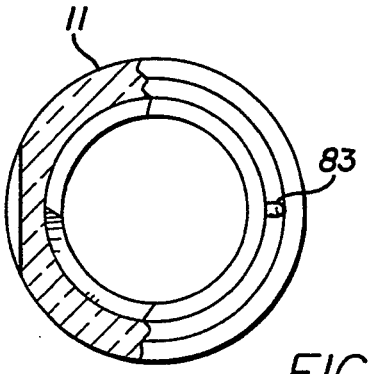
FIG. 13
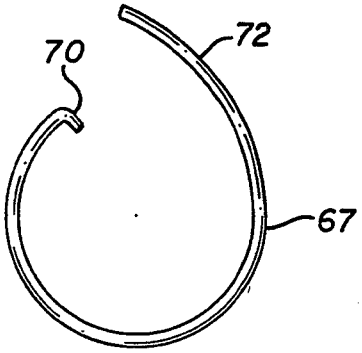
FIG. 14

PILL DISPENSER

BACKGROUND OF THE INVENTION

This invention relates to pill dispensers particularly suited for handling small pills and accurately dispensing one pill at a time. In particular, the invention relates to a dispenser in which the pills can be packaged by the manufacturer and subsequently stored, shipped and sold to the patient, with the dispenser package typically being a throw away item after the pills have been dispensed to the patient.

The present invention is particularly adapted for dispensing sequential pills, such as birth control pills (BCP). At times, patients are confused as to the sequence of the pills to be taken. In spite of the clear directions in the packet, the pills are sometimes taken in columns instead of rows, from downside to upside, or in the reverse direction.

In addition, many of the BCP dispensers are bulky and require a somewhat larger carrying space. The larger the dispenser, the greater the cost of producting the BCP case. One advantage of the pill dispenser of the present invention is its small size and ease of carrying, this increasing compliance.

Most importantly, the BCP case should reflect the population of the patients who are taking the pills, the majority of who are young females. Instead of the plastic matchbox look, the BCP case should have a unique shape to reflect the sophisticated patient who is taking the pills.

Therefore, disadvantages of the earlier dispensers include bulkiness, decrease in patient's compliance, possible high expenses in production, and difficulty in following the direction of the pills to be taken. Advantages of the present invention include uniqueness, small and easy to carry, increasing possible compliance, cheaper to manufacture, and pills taken in only sequential manner.

SUMMARY OF THE INVENTION

The presently preferred embodiment of the pill dispenser of the invention includes a barrel having an input end and and an output end, a sleeve for holding a stack of pills and positioned within the barrel, an output end cap removably positioned at the output end of the barrel, with the output end cap including cup means for receiving a pill while the output end cap is positioned on the barrel and plunger means for ejecting the pill from the cup means when the output end cap is removed from the barrel, and an input end cap positioned at the input end of the barrel, with the input end cap including pusher means sliding in the sleeve for pushing a pill from the sleeve into the cup.

Also the preferred embodiment includes drive means in the input end cap engaging the pusher means for advancing the pusher means through the sleeve, with the top of the input end cap rotatably mounted in the barrel and coupled to the drive means, with the drive means and barrel including interengaging threads for advancing drive means in the barrel and sleeve.

Further in the preferred embodiment, the sleeve has an axial slot and the drive means has a lateral marker projection riding in the sleeve slot, and the barrel has an axial transparent section overlying the sleeve slot with indica therealong, with the marker projection moving along the indica as pills are dispensed.

Further the output end cap has an axial passage with the cup means at one end and a retainer shoulder projecting inwardly, with the plunger means sliding in the passage and having an enlarged inner end adjacent said cup means and an outer end projecting from the axial passage, and spring means between the outer and inner ends of the plunge means urging the inner end into engagement with the shoulder, with manual pressure on the outer end moving the inner end away from the shoulder toward the cup means.

BRIEF DESCRIPTION OF THE DRAWINGS

FIG. 4 is an enlarged partial sectional view taken along the line 4—4 of FIG. 1;

FIG. 5 is an enlarged partial sectional view taken along the line 5—5 of FIG. 2;

FIG. 6 is a view of a portion of the pill holding sleeve;

FIG. 7 is a sectional view taken along the line 7—7 of FIG. 6;

FIG. 8 is an end view of the drive member of the dispenser;

FIG. 9 is a portion of the sleeve with the drive member therein;

FIG. 10 is an enlarged partial sectional view showing details of the rod 81 at the output end of the barrel 11;

FIG. 11 is an enlarged view of the input end cap 41 showing construction details;

FIG. 12 is an enlarged partial sectional view showing some details of the ratchet mechanism;

FIG. 13 is an enlarged sectional view taken along the line 12—12 of FIG. 2; and FIG. 14 is an enlarged view of the ratchet spring.

DESCRIPTION OF THE PREFERRED EMBODIMENT

Figure 3:
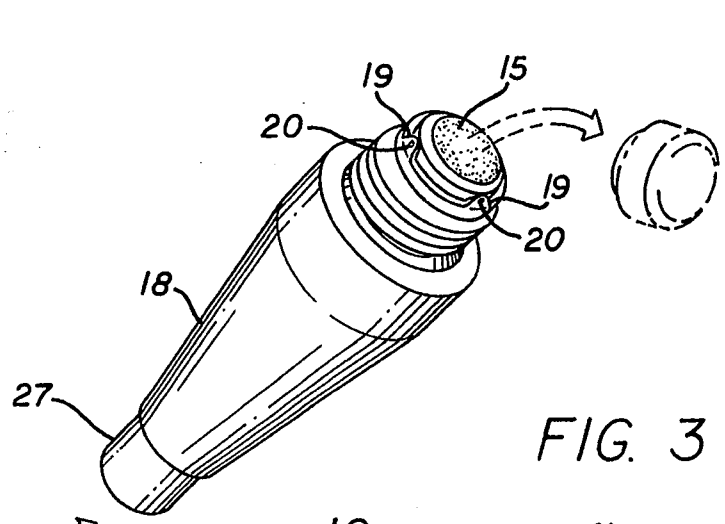
FIG. 3 is a perspective view of the output end cap of the dispenser illustrating dispensing of a single pill.
Figure 1:
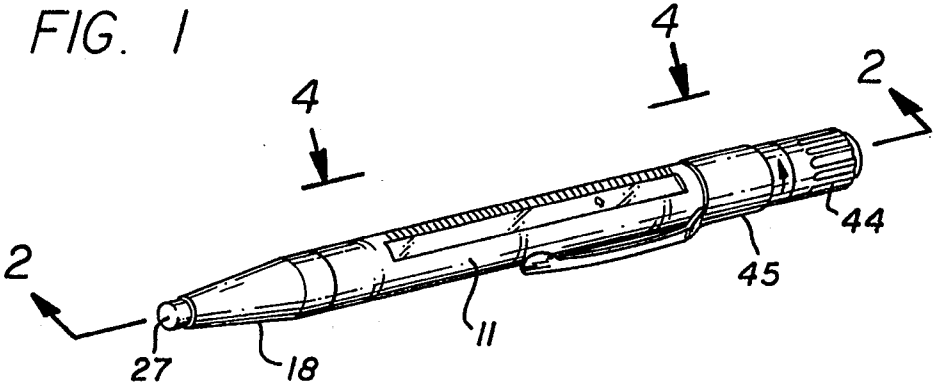
FIG. 1 is a perspective view of a pill dispenser incorporating the presently preferred embodiment of the invention.

The preferred embodiment of the pill dispenser of the invention as illustrated in the drawing figures includes a barrel 11 having an input end 12 and an output end 13. A sleeve 14 is positioned within the barrel 11 and holds a stack of pills 15.

The barrel 11 preferably is internally threaded, and an output end cap 18 is removably threaded into the barrel at the output end 13. The output end cap 18 has a plurality of fingers 19 at its inner end forming a cup for receiving a pill 15. Preferably inwardly projecting detents 20 are formed in the fingers 19 for restraining movement of a pill when the end cap 18 is removed from the barrel in the condition shown in FIG. 3.

Figure 2:
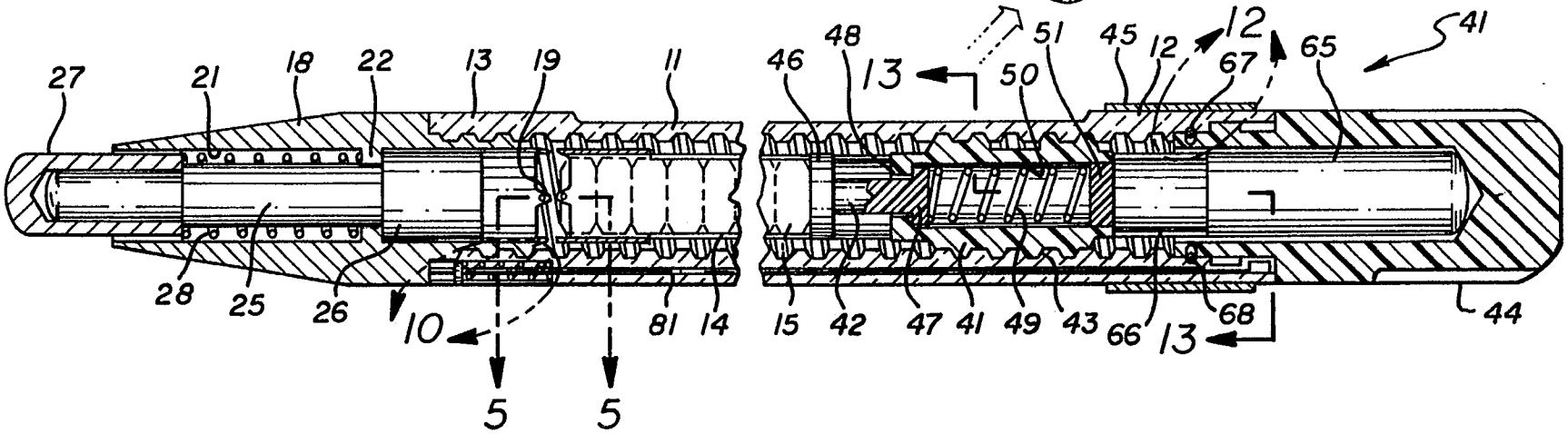
FIG. 2 is an enlarged sectional view taken along the line 2—2 of FIG. 1.

In the preferred embodiment, an axial passage 21 with an inwardly projecting shoulder 22 is provided in the output end cap 18. A plunger 25 with an enlarged inner end 26 and an outer end 27 projecting from the barrel slides in the passage 21. A spring 28 is positioned around the plunger 25 between the inner end 26 and outer end 27, urging the plunger outward, to the left as viewed in FIG. 2.

In operation, a pill 15 is pushed into the cup formed by the fingers 19 in a manner to be described. When the patient is ready to take a pill, the output end cap 18 is removed from the barrel and the outer end 27 of the end cap is manually depressed. This brings the inner end 26 into engagement with the pill and ejects it from the end cap, as illustrated in phantom lines in FIG. 3. The output end cap is then rethreaded into the barrel.

An axial slot 31 is provided in the wall of barrel 11 and preferably a set of indica 32 is printed on the outer wall adjacent this slot. Indica for four weeks is illustrated in FIG. 4. The sleeve 14 has an axial slot 33 corresponding to the slot 31 in the barrel, and preferably has another slot 34 opposite the slot 33. The slot 34 preferably is smaller than the slot 33. The sleeve 14 is loaded with a stack of pills 15, twenty-eight pills in the embodiment illustrated. A plurality of fingers 35 preferably with a detent 36 in each, is provided at the output end of the sleeve. The finger and detent construction for the sleeve may be the same as that for the output end cap, as seen in FIG. 5. This construction retains the pills within the sleeve until a pill is pushed out past the fingers. After the sleeve is loaded with the stack of pills, the sleeve is inserted into the barrel from the input end 12.

An input end cap 41 is carried at the input end 12 of the barrel and includes a pusher 42, a drive unit 43, and a top 44. A pocket clip 45 may be positioned on the barrel adjacent the input end cap 41. Typically the top 44 is provided with slots, for easier gripping to rotate the top.

Preferably the pusher 42 is made with enlarged ends 46, 47, and slides axially in an opening 48 in the drive unit 43. A spring 49 in an inner chamber 50 of the drive unit urges the pusher outward, to the left as viewed in FIG. 2, to apply pushing pressure on the stack of pills. The other end of the drive unit is closed by a cap 51.

The drive unit 43 has a projecting portion 61 which is threaded to mate with the internal threads of the barrel. This projecting portion has a width corresponding to the width of the slot 33 in the sleeve, so that the threaded portion 61 rides in the slot 33. Preferably the drive member has another threaded portion 62 opposite the threaded portion 61, which portion 62 rides in the smaller slot 34 of the sleeve. Typically a marker such as an arrow 63 is provided on the outer surface of the portion 61 for viewing through the slot 31 of the barrel. The slot 31 of the barrel may be closed with a clear plastic if desired.

A shaft 65 is pressed into the top 44 of the input end cap 41, and is rotated when the top is rotated. The shaft 65 is pressed into the upper end 66 of the sleeve 14 and rotation of the top 44 rotates the sleeve 14. Rotation of the sleeve causes the drive unit to translate axially toward the output end, pushing a pill from the end of the sleeve out of the fingers 35, into the fingers 19 of the output end cap 18. Preferably a ratchet mechanism 67 is provided between the top 44 and the barrel 11 for preventing reverse rotation of the top and also providing an indication when one complete revolution has been accomplished.

In the presently preferred ratchet mechanism, a C shaped spring 67 is positioned in mating grooves 68, 69 in the barrel 11 and input end cam 41, respectively. One end 70 of the spring is turned inward and fits in an opening 71 in the groove 69. The other end 72 of the spring 67 is urged outward against the wall of the groove 68 and rides over a rib 73 in the groove 68 as the end cap is rotated in the pill advance direction. Engagement of the spring end 72 with the groove rib 73 prevents rotation of the end cap in the opposite direction Also, the snap action of the spring end over the rib provides a click sound indicating that a revolution of the end cap has been completed.

The pill dispenser is supplied to the patient with the marker 63 at the first indica, SUN in the example illustrated. The sleeve is loaded with a stack of pills, with the pill at the output end between the fingers 35, as seen in FIG. 5. The patient rotates the top 44 one revolution, bringing the marker 63 opposite the indica MON. This action also advances the drive unit 43 one pill size and pushes the end pill of the stack from the fingers 35 into fingers 19 of the output end cap. The patient then unscrews the output end cap and pushes on the plunger outer end 27 ejecting the pill from the end cap. The end cap is then screwed back into the barrel, and the dispenser is ready for use the next day.

In the preferred embodiment a mechanism is provided to prevent rotation of the input end cap 41 when the output end cap 18 is removed from the barrel 11.

In the embodiment illustrated a rod 81 is slidingly positioned in a passage in the barrel. The input end of the rod is bent inward to form a finger 83 which can fit in between ribs 84 positioned around the input end cap 41.

A spring 85 is positioned in a passage 86 at the output end of the barrel and is retained in the passage by a plug 87 carried on the rod 81. The output end 88 of the rod 81 passes through the spring, and the length of the rod is selected such that when the end cap 18 is in place on the barrel the rod is moved to the right against the urging of the spring, positioning the end 83 of the rod above the ribs 84, as seen in FIG. 11. When the output end cap 18 is removed, the spring pushes the rod to the left, as seen in FIG. 10. This rod movement positions the rod end 83 between two of the ribs 84 preventing rotation of the input end cap 41. The upper ends of the ribs 84 preferably are tapered to facilitate entry of the rod end into a groove between the ribs.

We claim:

1. In a pill dispenser, the combination of:

a barrel having an input end and an output end;

a sleeve for holding a stack of pills, with said sleeve positioned within said barrel;

an output end cap removably positioned at said output end of said barrel, said output end cap including cup means for receiving a pill while said output end cap is positioned on said barrel, said plunger means for ejecting the pill from said cup means when said output end cap is removed from said barrel; and an input end cap positioned at said input end of said barrel, said input end cap including pusher means sliding in said sleeve for pushing a pill from said sleeve into said cup;

said input end cap including drive means engaging said pusher means for advancing said pusher means through said sleeve, said input end cap further including a top rotatably mounted in said barrel and fixed to said sleeve for rotating said sleeve, with said sleeve coupled to said drive means, said drive means and said barrel including interengaging threads for advancing said drive means in said barrel and sleeve as said top and sleeve are rotated.

2. A dispenser as defined in claim 1 wherein said sleeve has an axial slot and said drive means has a lateral marker projection riding in said sleeve slot, and said barrel has an axial transparent section overlying said sleeve slot with indica therealong, with said marker projection moving along said indica as pills are dispensed.

3. A dispenser as defined in claim 2 wherein said drive means has an inner chamber with an end of said pusher means carried therein, and including spring means carried in said inner chamber for urging said pusher means away from said drive means into engagement with the pills in said sleeve.

4. A dispenser as defined in claim 3 wherein said input end cap and barrel include interengaging ratchet means for limiting rotation of said input end cap relative to said barrel to one direction of rotation.

5. A dispenser as defined in claim 4 wherein said ratchet means includes a C shaped spring riding in mating grooves in said input end cap and barrel, said spring including means for attaching one end thereof in one of said grooves, and with a rib in the other said grooves for engaging the other end of said spring.

6. A dispenser as defined in claim 4 wherein said sleeve includes a plurality of spaced fingers at the pill outlet end thereof, said fingers having inwardly projecting detents for restraining movement of pills thereby.

7. A dispenser as defined in claim 2 wherein said output end cap has an axial passage with said cup means at one end and a retainer shoulder projecting inwardly, with said plunger means sliding in said passage and having an enlarged inner end adjacent said cup means and an outer end projecting from said axial passage, and spring means between said outer and inner ends of said plunger means urging said inner end into engagement with said shoulder, with manual pressure on said outer end moving said inner end away from said shoulder toward said cup means.

8. A dispenser as defined in claim 7 wherein said cup means includes a plurality of spaced fingers having inwardly projecting detents for restraining movement of pills thereby.

9. A dispenser as defined in claim 7 including a push rod slidingly carried in a passage in said barrel and having an input end and an output end, with means defining locking groove means in said input end cap for receiving said push rod input end for preventing rotation of said input end cap, and with spring means in said barrel at said output end of said push rod urging said rod toward said output end cap, with said rod output end projecting from said barrel when said output end cap is removed.

10. A dispenser as defined in claim 1 wherein said output end cap has an axial passage with said cup means at one end and a retainer shoulder projecting inwardly, with said plunger means sliding in said passage and having an enlarged inner end adjacent said cup means and an outer end projecting from said axial passage, and spring means between said outer and inner ends of said plunger means urging said inner end into engagement with said shoulder with manual pressure on said outer end moving said inner end away from said shoulder toward said cup means.

11. A dispenser as defined in claim 10 wherein said cup means includes a plurality of spaced fingers having inwardly projecting detents for restraining movement of pills thereby.

12. A dispenser as defined in claim 10 including a push rod slidingly carried in a passage in said barrel and having an input end and an output end, with means defining locking groove means in said input end cap for receiving said push rod input end for preventing rotation of said input end cap, and with spring means in said barrel at said output end of said push rod urging said rod toward said output end cap, with said rod output end projecting from said barrel when said output end cap is removed.

13. In a pill dispenser, the combination of:

a barrel having an input end and an output end;

a sleeve for holding a stack of pills, with said sleeve positioned within said barrel;

an output end cap removably positioned at said output end of said barrel, said output end cap including cup means for receiving a pill while said output end cap is positioned on said barrel, and plunger means for ejecting the pill from said cup means when said output end cap is removed from said barrel; and an input end cap positioned at said input end of said barrel, said input end cap including pusher means sliding in said sleeve for pushing a pill from said sleeve into said cup;

said input end cap including drive means engaging said pusher means for advancing said pusher means through said sleeve, and a top rotatably mounted in said barrel and fixed to said sleeve for rotating said sleeve, with said sleeve coupled to said drive means, said drive means and said barrel including interengaging threads for advancing said drive means in said barrel and sleeve as said top and sleeve are rotated;

said sleeve having an axial slot and said drive means having a lateral marker projection riding in said sleeve slot, with said barrel having an axial transparent section overlying said sleeve slot with indica therealong, with said marker projection moving along said indica as pills are dispensed;

said drive means having an inner chamber with an end of said pusher means carried therein, and including spring means carried in said inner chamber for urging said pusher means away from said drive means into engagement with the pills in said sleeve, with said sleeve including a plurality of spaced fingers at the pill outlet end thereof, said fingers having inwardly projecting detents for restraining movement of pills thereby;

said output end cap having an axial passage with said cup means at one end and a retainer shoulder projecting inwardly, with said plunger means sliding in said passage and having an enlarged inner end adjacent said cup means and an outer end projecting from said axial passage, and spring means between said outer and inner ends of said plunger means urging said inner end into engagement with said shoulder, with manual pressure on said outer end moving said inner end away from said shoulder toward said cup means.

* * * * *